US005632139A

United States Patent [19]

Tate

[11] Patent Number: 5,632,139

[45] Date of Patent: May 27, 1997

[54] YARN COMMINGLING APPARATUS AND METHOD

[75] Inventor: John E. Tate, Greensboro, N.C.

[73] Assignee: Southridge Corporation, Greensboro, N.C.

[21] Appl. No.: 627,887

[22] Filed: Apr. 3, 1996

[51] Int. Cl.[6] ..... D02G 3/22

[52] U.S. Cl. ..... 57/351; 57/333; 57/350

[58] Field of Search ..... 57/333, 350, 351

[56] References Cited

U.S. PATENT DOCUMENTS

| | | | |
|---|---|---|---|
| 3,094,374 | 6/1963 | Smith | 57/333 |
| 3,279,164 | 10/1966 | Breen et al. | 57/333 |
| 3,529,323 | 9/1970 | Hughey | 57/333 |
| 3,683,608 | 8/1972 | Buzano | 57/333 |
| 3,695,025 | 10/1972 | Gibbon | 57/333 |
| 3,707,837 | 1/1973 | Gibbon | 57/333 |
| 3,958,310 | 5/1976 | Blanc et al. | 28/72 |
| 4,064,684 | 12/1977 | Nijhuis | 57/333 |
| 4,099,308 | 7/1978 | Wesley | 28/273 |
| 4,112,658 | 9/1978 | Morihashi | 57/333 |
| 4,121,411 | 10/1978 | Shindo et al. | 57/77 |
| 4,183,202 | 1/1980 | Morihashi | 57/333 |
| 4,219,998 | 9/1980 | Farnhill | 57/333 |
| 4,430,780 | 2/1984 | Sear et al. | 28/272 |
| 4,468,921 | 9/1984 | Shibata et al. | 57/333 |
| 4,497,167 | 2/1985 | Nakahara et al. | 57/328 |
| 4,569,193 | 2/1986 | Anahara et al. | 57/350 |
| 4,858,288 | 8/1989 | Hodgin et al. | 57/350 |
| 4,934,134 | 6/1990 | Niederer | 57/333 |
| 4,965,916 | 10/1990 | Artunc et al. | 57/333 |
| 5,148,586 | 9/1992 | Coons, III | 28/271 |

*Primary Examiner*—Daniel P. Stodola
*Assistant Examiner*—Tina R. Taylor

[57] ABSTRACT

An apparatus and method of using the same are presented for commingling synthetic multifilament yarns such as polyester or the like. The apparatus includes a pair of spaced apart fluid jets which direct air at an acute angle from different directions to the moving yarn to distort and mesh the filaments. The first fluid jet is directed in a forward direction (with the yarn travel) whereas the second jet is in a reverse or opposing direction to the yarn path. The method utilizes compressed air and a high velocity yarn to form nips therealong at approximately 10 to 14 millimeter spacings to create a commingled yarn which is cohesive for use on high speed looms and for other operations.

17 Claims, 4 Drawing Sheets

YARN COMMINGLING APPARATUS AND METHOD

BACKGROUND OF THE INVENTION

1. Field of the Invention

The device and method as described herein relates to the processing of synthetic yarn and specifically to the processing of multifilament yarn by commingling the filaments by fluid impingement as the yarn moves along a directed path.

2. Description of the Prior Art and Objectives of the Invention

The processing of multifilament yarns such as polyester, polypropylene and other synthetic types is greatly enhanced when the filaments are sufficiently adhered so the yarn can be smoothly directed along guides, eyelets, rollers and other means, as for example when used in weaving, knitting or other procedures. The cohesion of multifilament yarns has been devised in the past by imparting a twist to the yarn. In recent years an alternative cohering method has been employed using air entanglement to provide cohesion without twisting the yarn filaments. Air entanglement or "commingling" the yarn induces filament intersections or nips which, if properly spaced, allow the yarn to be more easily handled during subsequent processing. If only a limited number of nips per meter, having low cohesion, is sufficient for a particular operation, such as 5–10 nips per meter, then air jets of conventional design can be employed at relatively high yarn speeds. U. S. Pat. No. 3,958,310 demonstrates one of many conventional methods for interlacing multifilament yarns using streams or jets of air.

If closely spaced and more durable nips are required, it has been necessary in the past to utilize entanglement processes which provide low tension to the yarn but at relatively low operating speeds. Such low speed processes can cause the yarn costs to escalate. A low tension, high speed air entanglement process has thus not been available prior to the invention described herein to provide the cohesion desired for modern high speed looms and other equipment.

SUMMARY OF THE INVENTION

A yarn commingling apparatus and method are presented which utilize a pair of oppositely directed fluid jets which are spaced apart to create a reduced tension zone for yarn traveling at high rates of speed, such as in the two thousand meters per minute range. Each fluid jet is affixed to and is in fluid communication with a manifold which receives fluid such as pressurized air through an inlet stud connected to an air source such as a standard air compressor. The air may be delivered to the manifold at 80–90 psig for passage to the fluid jets. The first jet impinging the moving yarn with an air stream directs air at an acute angle, such as at 15°–20° to the perpendicular of the yarn path in a forward direction to the yarn. A second air jet, spaced along the yarn path from the first jet likewise delivers air to the yarn, also at an acute angle of from 15°–20° to the perpendicular of the yarn path, but in an opposite direction or rearwardly of the passing yarn. As such jets are oppositely positioned, a zone of low yarn tension is created between the jets, thus allowing commingling of the yarn and the forming of nips. Such nips are durable even though formed at high speeds with a large number of nips per meter, such as 90–100. The commingled yarn produced thereby is quite cohesive and is easily handled when used with modern, high speed looms and other yarn processing equipment.

DETAILED DESCRIPTION OF THE PREFERRED EMBODIMENT AND OPERATION OF THE INVENTION

Figure 1:
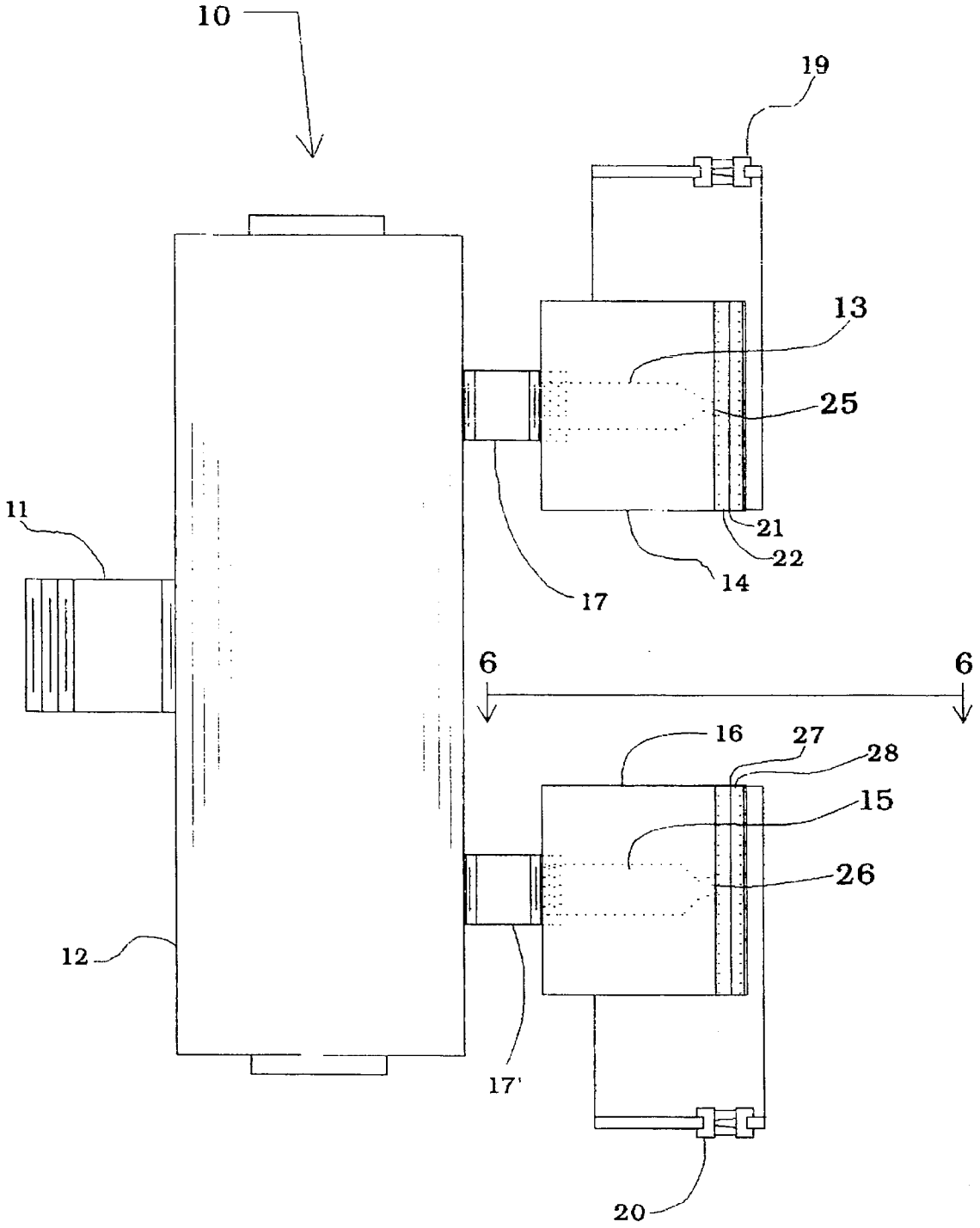
FIG. 1 shows the preferred form of the yarn commingling apparatus of the invention without yarn or fluid supply lines.

For a better understanding of the invention and its operation, turning now to the drawings, FIG. 1 illustrates the preferred form of yarn commingling apparatus 10 having an air inlet stud 11 joined to manifold 12 for supplying air to a first or forwarding standard air jet 25 contained within housing 14 and to a second or reversing standard air jet 26 contained within housing 16 through respectively, air conduits 17, 17' and air passages 13 and 15. Entry yarn guide 19 is affixed to housing 14 which contains air jet 25 and exit yarn guide 20 is affixed to housing 16 which contains air jet 26. As seen, air jets 25 and 26 are spaced substantially apart as will be hereinafter more fully explained.

In use, compressed air from an air compressor (not shown) as is commonly available at 80–90 psig is connected to inlet 11 which allows pressurized air to then pass into manifold 12 through conduits 17, 17' for supplying respectively, first air jet 25 and second air jet 26 as shown in dotted lines in FIG. 1. Yarn 50 (FIG. 3) which is to be commingled, is a 300 denier, 72 filament polypropylene yarn at a velocity of 2000 meters/minute is introduced to yarn guide 19 and is passed through v-shaped groove 21 into tube 22(FIG. 2) in housing 14 where it is impinged by air from first air passage 13 which directs air to air jet 25 (FIG. 2) causing the filaments of yarn 50 to entangle as they pass therealong, as shown more clearly in FIG. 3.

Figure 2:
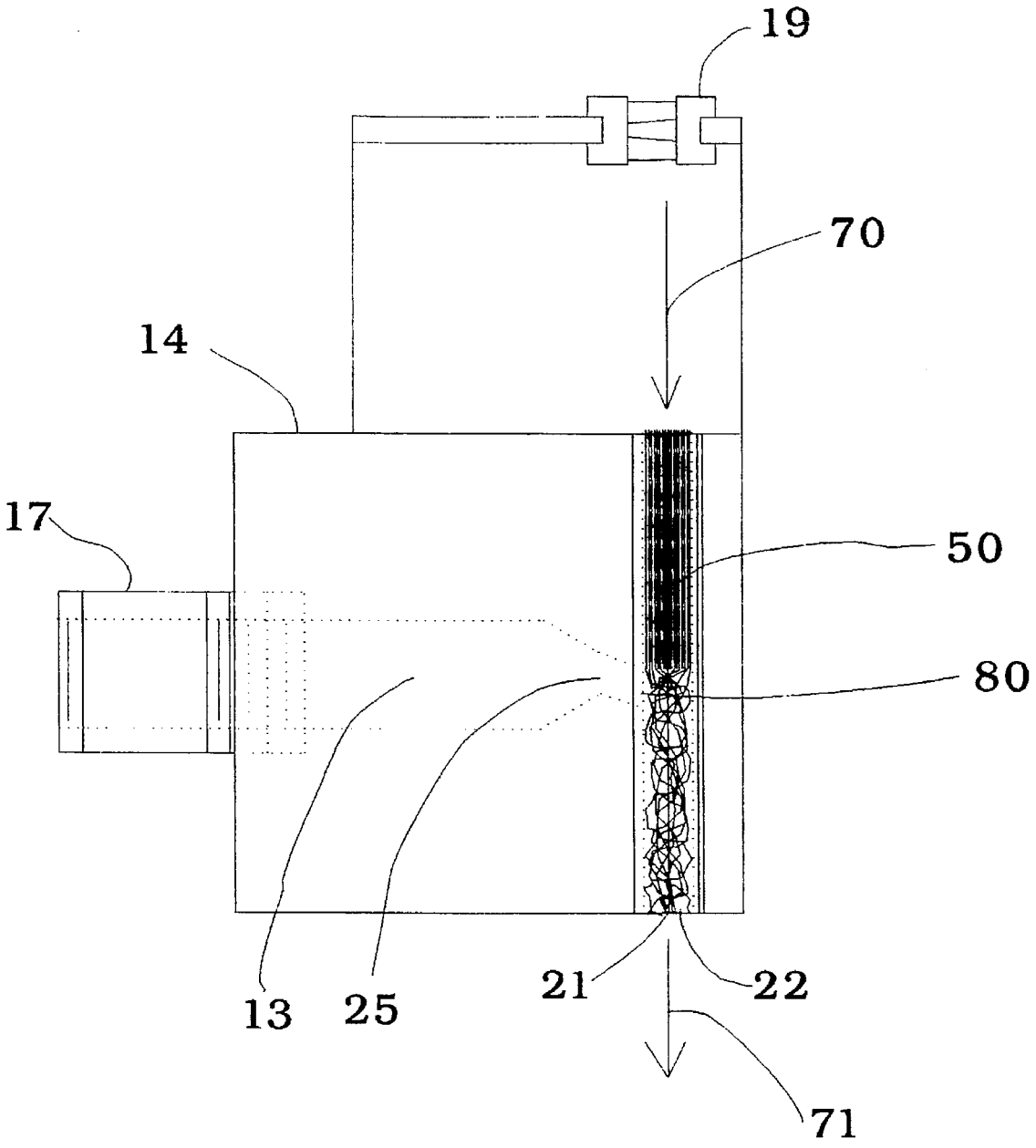
FIG. 2 demonstrates an enlarged view of the housing for the forwarding air jet as removed from the manifold.
Figure 3:
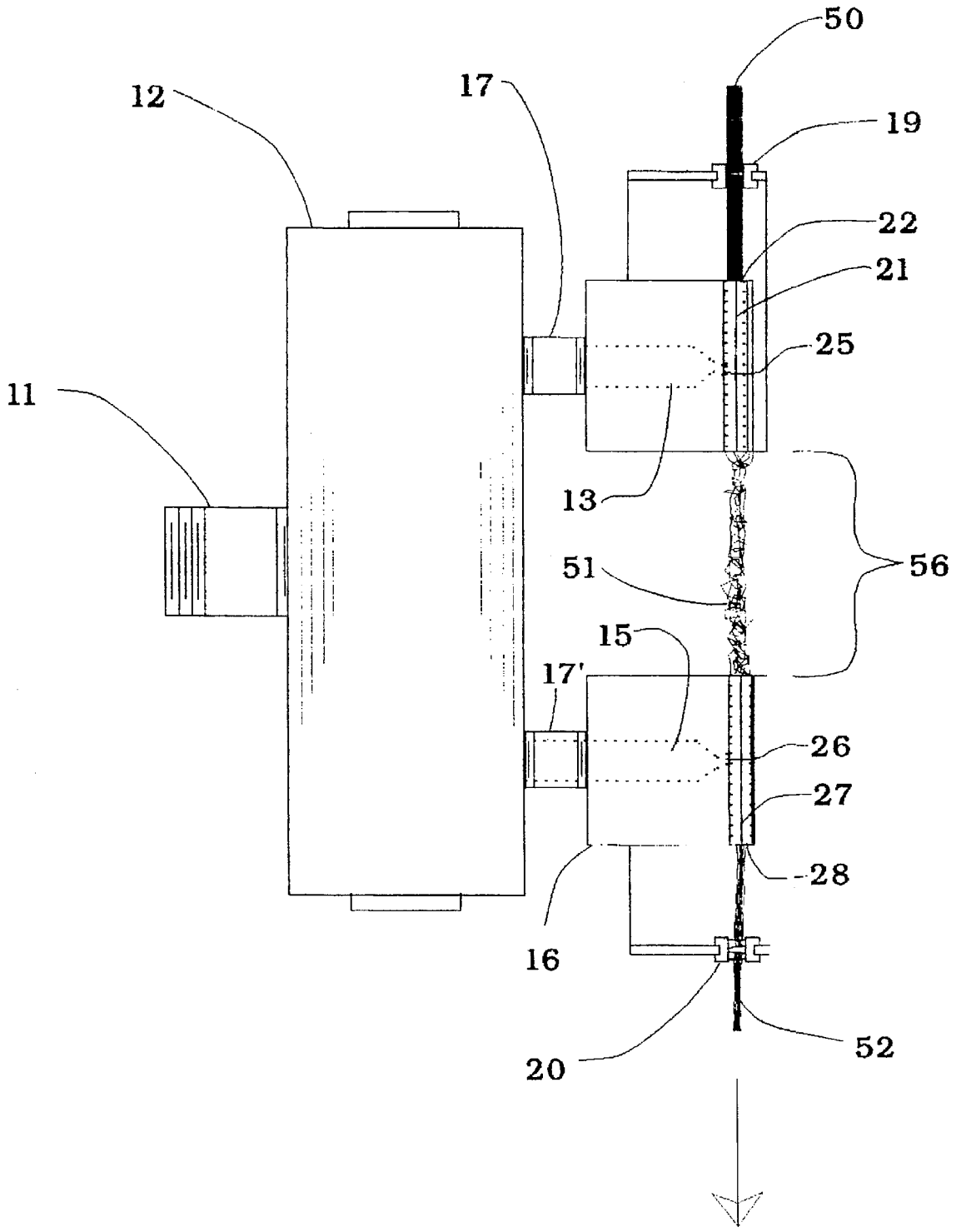
FIG. 3 illustrates the embodiment as seen in FIG. 1 with yarn being directed therethrough for commingling purposes.

In FIG. 2 air jet 25 is featured angularly disposed to the path of yarn 50 (tube 22) preferably at an acute angle of 20° to the perpendicular of the yarn to direct air forwardly, along the direction of yarn travel. The travel path of yarn 50 is represented by arrows 70 and 71. Air jet 25 defines fluid outlet 80. Commingling apparatus 10 is shown in FIG. 3 with entry guide 19 receiving yarn 50 as from a conventional spin/draw machine (not shown) at 2000 meters/minute. Other types of synthetic multifilament yarns could also be processed by apparatus 10 such as draw/textured yarn as is known in the textile trade.

Figure 4:
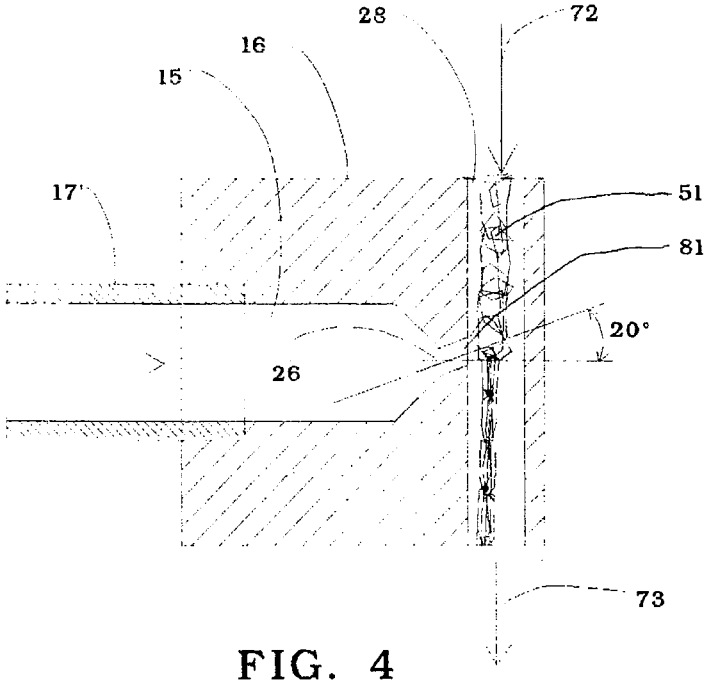
FIG. 4 shows an enlarged cross-sectional view of the rearwardly directed jet as seen along lines 4—4 in FIG. 6.
Figure 6:
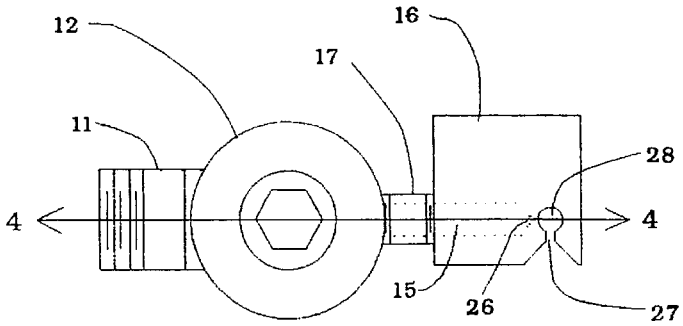
FIG. 6 illustrates a view of the rearwardly directed jet housing as shown in FIG. 1 along lines 6—6.

As further shown in FIG. 3, polypropylene multifilament yarn 50 undergoes commingling by the impingement of first air jet 25 contained within housing 14. This commingling effect is continued between housing 14 and housing 16 where low tension zone 56 is formed, in part due to reversing or second air jet 26 within housing 16 which points its air stream against the path of travel of yarn 50. Second air jet 26 directs air at an acute angle of, preferably 20° to the perpendicular of the path of yarn travel, as shown in FIG. 4. Other angles of the impinging air jets 25, 26 can be used with 15°–20° angles being the optimum for providing a yarn with excellent cohesion and properly spaced intersections or nips 55 (See FIG. 5).

An enlarged view of conventional air jet 26 in FIG. 4 is shown with air jet 26 positioned at a 20° angle relative to the perpendicular of yarn 51. The travel path of yarn 51 is illustrated by arrows 72 and 73. Air jet 26 defines fluid outlet 81. While other air jet angles can be used, an acute angle of from 15°–20° to the perpendicular of the yarn path for forwarding air jet 25 and reversing air jet 26 have been found to work most effectively for yarn velocities of 2000 meters per minute with air pressure supplies of 60–90 psig.

Figure 5:
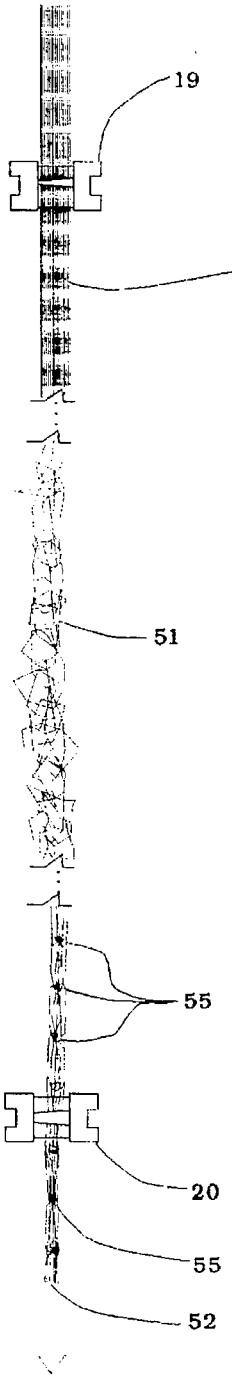
FIG. 5 depicts the multifilament yarn enlarged and in various stages of the commingling process.

In FIG. 5 an enlarged representation of the yarn at various processing stages is shown. Yarn 50 represents 72 filament 300 denier polypropylene yarn as directed from a usual spin/draw machine. Yarn 51 demonstrates the initial effects of commingling as it passes through tube 22 and into low tension zone 56. The effects of the air impingement at different or opposing directions by air jets 25 and 26 is seen by resultant yarn 51. Next, as the yarn undergoes final impingement by air jet 26 as it passes through tube 28 and past guide 20, yarn 52 is illustrated which has a series of closely spaced intersections or nips 55 which are somewhat regularly spaced about every 10–14 mm for providing about 100 nips 55 per meter of yarn. As shown in FIG. 3, air jet 25 and air jet 26 are spaced about 85–100 mm apart for an air pressure of 60–80 psig, although other distances and air pressures could be used for different yarns, and for different yarn velocities.

The preferred method utilizes a 72-filament polypropylene yarn of 300 denier which travels along apparatus 10 at 2000 meters/minute. Jets 25, 26 configured at a 20° angle to the perpendicular of the yarn path and operate at 80–90 psig. Jets 25, 26 are spaced at 90–100 mm apart in the preferred apparatus to form sufficiently long, low yarn tension zone 56.

The illustrations and examples provided herein are for explanatory purposes and are not intended to limit the scope of the appended claims.

I claim:

1. Apparatus for commingling yarn, said apparatus comprising: a first fluid jet, a second fluid jet, said first jet spaced from said second jet, said first and second jets positioned along a yarn path to direct fluid against yarn passing therealong, said first fluid jet having a fluid outlet disposed at an acute angle relative to the perpendicular of said yarn path, said second fluid jet having a fluid outlet disposed at an acute angle relative to the perpendicular of said yarn path, said first jet fluid outlet angularly disposed in the direction of the passing yarn, and said second jet fluid outlet angularly disposed in an opposite direction to the passing yarn.

2. The apparatus of claim 1 wherein said first fluid jet is spaced from said second fluid jet to form a zone of low yarn tension therebetween.

3. The apparatus of claim 1 wherein said first jet fluid outlet is directed at a 15–20° angle to the perpendicular of said yarn path.

4. The apparatus of claim 1 wherein said second jet fluid outlet is directed at an angle of 15–20° to the perpendicular of said yarn path.

5. The apparatus of claim 1 wherein said first jet fluid outlet is directed at a 20° angle to the perpendicular of said yarn path.

6. The apparatus of claim 1 wherein said second jet fluid outlet is directed at an angle of 20° to the perpendicular of said yarn path.

7. Apparatus for continuously commingling multifilament yarn directed along a path, said apparatus comprising: a first fluid jet, said first fluid jet defining a first fluid outlet directed toward the yarn path at an acute angle relative to the perpendicular of the yarn path, said first fluid outlet directed along the travel path of the yarn, a second fluid jet, said second fluid jet defining a second fluid outlet directed toward the yarn path at an acute angle relative to the perpendicular of the yarn path, said second fluid outlet directed against the travel path of the yarn, a manifold, said first and said second fluid jets in fluid communication with said manifold, said first jet spaced from said second jet along said yarn path.

8. The apparatus of claim 7 wherein said first fluid outlet is disposed at a 20° angle to the perpendicular of said yarn path.

9. The apparatus of claim 7 wherein said second fluid outlet is disposed at an angle of 20° to the perpendicular of said yarn path.

10. The apparatus of claim 7 wherein air is directed through said jets to impinge said yarn.

11. The apparatus of claim 7 wherein said first and said second fluid jets form a low yarn tension zone therebetween.

12. A method for commingling multifilament yarn by a pair of fluid jets positioned to direct fluid against the yarn in opposing directions comprising the steps of:

(a) passing the yarn along a prescribed path;

(b) directing fluid from a first fluid jet against said yarn at an acute angle relative to the perpendicular of the yarn path, the first fluid jet being directed along the yarn path; and (c) subsequently directing fluid from a second fluid jet against said yarn at an acute angle relative to the perpendicular of the yarn path to thereby commingle the yarn, the second fluid jet being directed against the yarn path.

13. The method of claim 12 wherein directing fluid from a first jet comprises directing air from a first jet.

14. The method of claim 13 wherein directing fluid at an angle from a first jet comprises directing fluid at a 20° angle to the perpendicular of the yarn path.

15. The method of claim 12 wherein directing fluid in an angular direction from a first jet comprises directing fluid at an angle of 15–20° to the perpendicular of said yarn path.

16. The method of claim 12 wherein passing the yarn along a prescribed path comprises passing a multi-filament yarn along a prescribed path.

17. The method of claim 12 wherein passing the yarn along a prescribed path comprises passing the yarn along the path at a velocity of 2000 meters per minute.

* * * * *